US007007611B2

(12) United States Patent
Auer

(10) Patent No.: US 7,007,611 B2
(45) Date of Patent: Mar. 7, 2006

(54) SELF STEERING, THREE-AXLE BOGIE

(75) Inventor: Wolfgang Auer, Kassel (DE)

(73) Assignee: Bombardier Transportation GmbH

( * ) Notice: Subject to any disclaimer, the term of this patent is extended or adjusted under 35 U.S.C. 154(b) by 0 days.

(21) Appl. No.: 10/473,067

(22) PCT Filed: Mar. 27, 2002

(86) PCT No.: PCT/EP02/03471

§ 371 (c)(1),
(2), (4) Date: Mar. 22, 2004

(87) PCT Pub. No.: WO02/081284

PCT Pub. Date: Oct. 17, 2002

(65) Prior Publication Data

US 2004/0149162 A1 Aug. 5, 2004

(30) Foreign Application Priority Data

Mar. 27, 2001 (DE) ..... 101 15 960

(51) Int. Cl.
*B61B 3/00* (2006.01)

(52) U.S. Cl. ..... 105/166

(58) Field of Classification Search ..... 105/165, 105/166, 167, 168, 196, 218.2
See application file for complete search history.

(56) References Cited

U.S. PATENT DOCUMENTS

| | | | | | |
|---|---|---|---|---|---|
| 184,823 | A | * | 11/1876 | Bleakley | 105/166 |
| 2,792,791 | A | * | 5/1957 | Kreissig | 105/416 |
| 4,542,700 | A | | 9/1985 | Smith | |
| 4,679,507 | A | * | 7/1987 | Rassaian | 105/136 |
| 5,375,533 | A | * | 12/1994 | Schwendt | 105/166 |
| 5,613,444 | A | * | 3/1997 | Ahmadian et al. | 105/166 |

FOREIGN PATENT DOCUMENTS

| | | | |
|---|---|---|---|
| DE | 44 15 294 | A | 11/1995 |
| EP | 0 658 465 | A | 6/1995 |
| EP | 0 679 560 | A | 11/1995 |

* cited by examiner

*Primary Examiner*—Mark T. Le
(74) *Attorney, Agent, or Firm*—Jacobus C. Rasse; David P. Owen; Howrey LLP

(57) ABSTRACT

A self-steering, three-axle bogie, in particular for a rail vehicle, comprising wheel sets and wheel set bearing housings allocated to the sets. The outer wheel sets are counter-coupled and can be displaced in a longitudinal direction and the central wheel set can be displaced in a transverse direction. The wheel set bearing housings on each side of the running gear are coupled to the wheel set bearing housings lying on the same side.

2 Claims, 1 Drawing Sheet

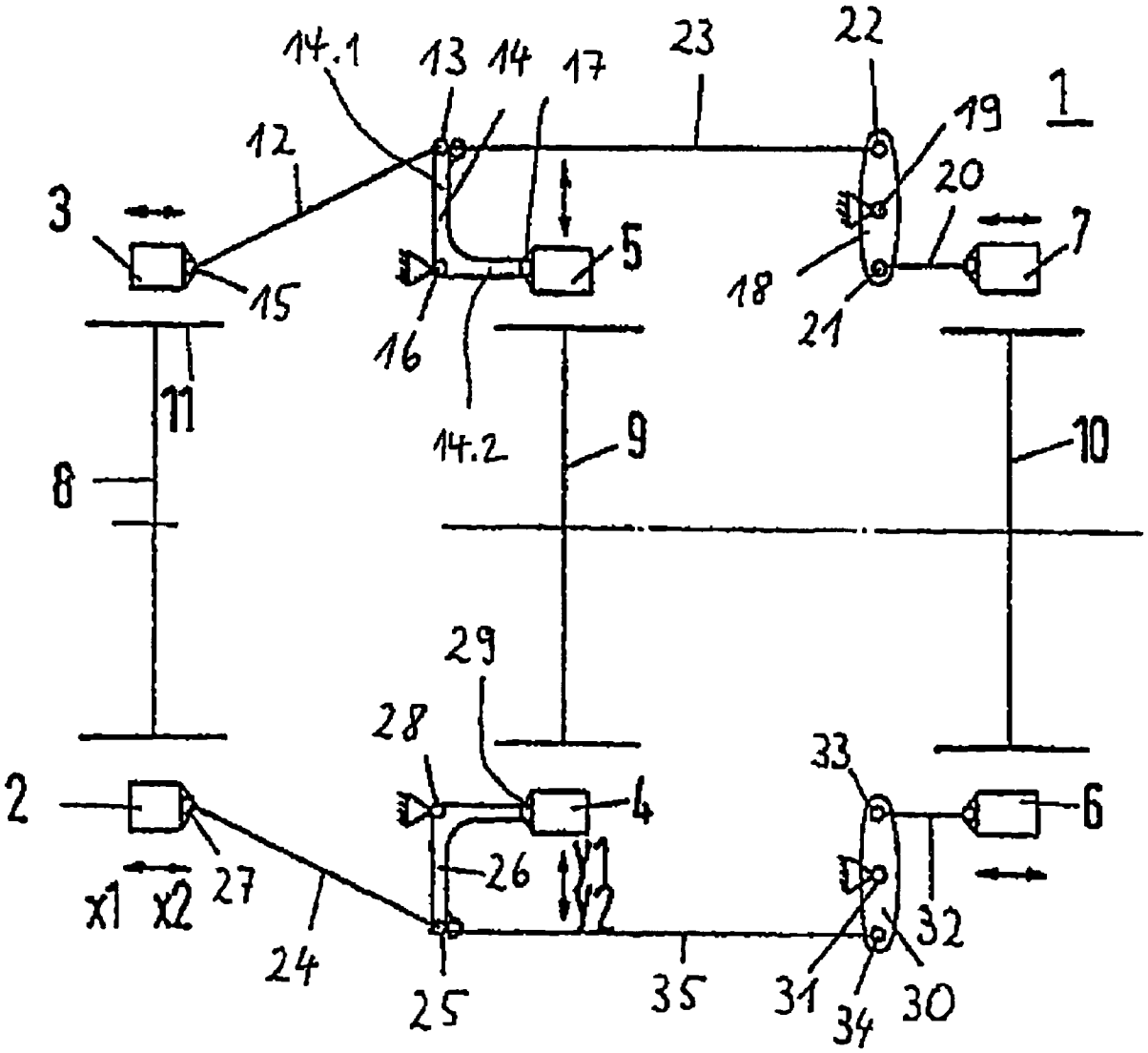
1
2
3
4
5
6
7
8
9
10
11
12
13
14
14.1
14.2
15
16
17
18
19
20
21
22
23
24
25
26
27
28
29
30
31
32
33
34
35
X1
X2

SELF STEERING, THREE-AXLE BOGIE

The invention relates to a self-steering three-axle bogie, in particular for a rail vehicle, comprising wheel sets and associated wheel set bearing housings, wherein the outer wheel sets are counter-coupled and can be displaced in longitudinal direction, and the central wheel set can be displaced in transverse direction and is included in the control system, and wherein the wheel set bearing housings on one side of the running gear and/or the wheel set bearing housings on the other side of the running gear are coupled exclusively to the wheel set bearing housings lying on the same side of the running gear.

The invention is particularly suited to application in rail vehicles, in particular in locomotives. However, it is not limited to such applications.

A self-steering three-axle bogie for a rail vehicle is for example known from DE 38 24 709 C2. This bogie is associated with a disadvantage in that the central wheel set is not included in the control system, but instead, only the outer wheel set which is leading in the direction of travel, and the outer wheel set which is trailing, are steered by way of corresponding steering linkages. As a result of this, the adaptability of the running gear to tighter radii of curvature is severely limited, so that in tight curves disadvantageously high tracking forces are experienced.

In order to remedy this disadvantage it has been proposed to include the central wheel set in the control system too. For example, DE 44 15 294 A1 discloses a corresponding self-steering three-axle bogie with so-called steering beams by way of which the wheel bearing housing of the two sides of the running gear are coupled. This arrangement is associated with a disadvantage in that, as a consequence of the transverse connection between the sides of the running gear by way of the steering beam, design space is used, if need be even in the interior of said running gear.

From DE 41 42 255 C2 a generic three-axle bogie is known. In this arrangement the outer wheel sets are counter-coupled and arranged so as to be displaceable in longitudinal direction of the vehicle. The central wheel set is displaceable in transverse direction, i.e. transversely to the longitudinal direction, and is included in the control system. The displaceability mentioned is ensured by conventional spring elements by way of which the wheel sets are attached to the running gear frame. This bogie overcomes the above-mentioned disadvantage, in that the wheel set bearing housings are now only coupled on the respective side of the running gear, and in that—apart from the (internal) connection by way of the respective wheel sets—in the sense of the present description there is no longer any (external) coupling between the wheel set bearing housings of the two sides of the running gear. Coupling between neighbouring wheel set bearing housings is by way of a rotary lever. While this configuration saves a considerable amount of design space, it is however associated with the following disadvantages. While inclusion of the central wheel set in the control system makes it possible to achieve adaptation to almost any track curvature, depending on said track curvature there is nonetheless a more or less considerable striking angle between the wheel flange of the respective outer wheel set and the outer rail, which striking angle increases wear and tear and has thus a negative effect on the service life of the wheel set.

U.S. Pat. No. 4,679,507 describes a further generic three-axle bogie for rail vehicles in which steering rods and angular levers are coupled to the wheel set bearing housing of the central wheel set. Coupling of the wheel set bearing housings among themselves is by way of rotary levers and steering linkages, with rotary levers impacting on the wheel set bearing housing of the central wheel set with a certain clearance by way of resilient pads. In this arrangement, the central wheel set is guided by way of special steering rods transversely to the longitudinal direction or direction of travel. This arrangement is associated with a disadvantage in that it necessitates at least two different points of connection at the wheel set bearing housing, so that this solution is relatively expensive to implement.

It is thus the object of the present invention to disclose a generic bogie which does not have the described disadvantages of the state of the art, or at least has them to a lesser extent, and in particular which ensures good reduction of the striking angle while being of simple design.

The present invention is based on the technical teaching according to which a generic bogie which is of simple design and ensures a good reduction in the striking angle can be obtained if neighbouring wheel set bearing housings are coupled, by way of a steering-linkage/rotary lever configuration, to a first rotary lever which is connected, so that it can rotate, to the associated wheel set bearing housing of the central wheel set.

Compared to the arrangement known from DE 41 42 255 C2, this combination of steering linkages and rotary levers provides the arrangement according to the invention with an additional degree of freedom in the plane which is arranged parallel to the track plane. While in the known arrangement the angle position of the respective outer wheel set in relation to the rail, i.e. the striking angle, at a particular curvature of the track is defined by the angular levers and is invariable, in the solution according to the invention, thanks to this additional degree of freedom, the respective outer wheel set can essentially adjust radially as a result of the predominant striking forces at the outer rail. Consequently, the striking angle is considerably reduced. As a rule, a reduction essentially to zero is possible, which advantageously leads to a clear reduction in the wear and tear of the wheel sets.

The configuration according to the invention, with the first rotary lever which is connected, so that it can rotate, to the associated wheel set bearing housing of the central wheel set, has the additional advantage in that this is a very simple and space-saving arrangement which in addition also meets the function of a guide, in particular of a transverse guide for the central wheel set. Thus, advantageously, such a guide requires no additional functional components—such as corresponding steering rods as they are known from U.S. Pat. No. 4,679,507.

The steering-linkage/rotary lever configuration is preferably designed and arranged such that a striking angle of less than 10° results between the, in relation to the track, curve, outer wheel of the outer wheel set and the outer rail of the track curve. This can be achieved by a corresponding selection of the length of the steering and rotary levers as well as the arrangement of the coupling points or fulcrums. Preferably, the striking angle is less than 5°. Further preferably, the striking angle resulting in curves is essentially 0° so that wear of the wheel flange at the outer wheel is reduced to a minimum.

The coupling of wheel set bearing housings can take place either on one side or on both sides, i.e. either on one side of the running gear or on both sides of the running gear. Advantageous variants of the bogie according to the invention provide for the couplings of the wheel set bearing housings of one side of the running gear to be provided in a symmetrical manner as they are provided for the wheel set bearing housings of the other side of the running gear, said symmetry being in relation to the longitudinal axis of the rail vehicle. In this way, particularly favourable steering behaviour is achieved, irrespective of the orientation of the track curve being driven on, with even wear and tear of the wheels of the respective wheel set being achieved.

Preferred variants of the bogie according to the invention—at least in the neutral position on a straight track—provide for a first steering linkage, arranged transversely in relation to the longitudinal direction, between a first joint on the first rotary lever and a second joint on the wheel set bearing housing of a first outer wheel set. The inclined position of the first steering linkage, as a result of the ensuing motion component directed towards the inside of the track curve, advantageously favours radial alignment of the outer wheel set in relation to the track curve, and thus a reduction in the striking angle.

Steering behaviour which is particularly favourable in relation to a reduction in the striking angle results in configurations which on both sides provide a first steering linkage which is correspondingly positioned at an incline.

Basically, the first rotary lever can be designed as desired. Preferably, it is an angular lever comprising a first arm and a second arm as well as a fulcrum pin which is fixed to the frame, as this provides a configuration which is particularly simple in design.

In this arrangement, in its neutral position, the first arm is preferably aligned transversely in relation to the longitudinal axis of the vehicle, particularly preferably perpendicularly, in order to achieve correspondingly large control movements, depending on the transverse displacement of the central wheel set, which control movements make possible optimal adaptation to a wide range of track curvatures.

The first rotary lever may be connected to any point of the associated wheel set housing of the central wheel set by way of a third joint arranged on said rotary lever's second arm. Preferably, the first rotary lever is connected to the face of the wheel set bearing of the central wheel set by way of a third joint which is arranged on said rotary lever's second arm. This results in an arrangement which is particularly easy to produce and to service.

Incidentally, particularly favourable motion transfer is achieved if the fulcrum of the first rotary lever and the coupling point of the first rotary lever to the wheel set bearing of the central wheel set are positioned on a line which in the neutral position is essentially parallel in relation to the longitudinal direction of the vehicle. To this effect, the second arm of the first rotary lever, which first rotary lever is an angular lever, can for example in its neutral position essentially be aligned in longitudinal direction of the vehicle.

Preferred variants (preferred because they are of particularly simple design) of the bogie according to the invention provide for a second rotary lever with a fulcrum pin which is fixed to the frame, said second rotary lever being associated with the wheel set bearing housing of a second outer wheel set. In this arrangement, a second steering linkage which leads to the wheel set bearing housing of the second outer wheel set is coupled to a fourth joint of the second rotary lever. A fifth joint of the second rotary lever, which fifth joint in the neutral position is arranged beyond the fulcrum pin in relation to the longitudinal direction of the vehicle, is connected to a third steering linkage which leads to a joint on the first rotary lever. This configuration with the second rotary lever achieves in a simple way counter-coupling of the first and second outer wheel set.

In this arrangement, the second rotary lever can be of any design. Preferably, it is a simple straight lever.

The position of the fulcrum pin of the second rotary lever between the fourth and the fifth joint can be selected depending on the desired or required motion transfer between the wheel set bearing housing of the central wheel set or the first rotary lever and the wheel set bearing housing of the second outer wheel set. In preferred variants the fulcrum pin of the second rotary lever is centred.

The third steering linkage can be coupled in any desired way to the first rotary lever. Preferably, the third steering linkage leads to the region of the first joint on the first rotary lever in order to achieve particularly favourable motion transfer. Preferably, the third steering linkage leads to the first joint on the first rotary lever in order to achieve a particularly simple design, since in this case only one joint is required at that position for coupling the first steering linkage and the third steering linkage.

There are further advantages of the invention in that no additional design space is used in the interior of the running gear, and that at the same time the central wheel set is also included in the control system so that all three wheel sets are used for steering in curves. There is a further advantage in that only existing points of connection are used on the wheel set bearing housings, and only relatively few components are required.

As a result of active inclusion of the central wheel set in the control system the horizontal spring excursion forces of the wheel set springs, which forces oppose the control motion, can be overcome more easily, and in particular in curves with tighter radii in which larger horizontal excursions of the wheel set springs are required, the alignment of the wheel set shaft in relation to the centre of the curve is improved.

Advantageous embodiments and improvements of the invention result from the dependent claims or the following description of a preferred embodiment which refers to the enclosed drawing, which shows a diagrammatic representation of the running gear of a preferred embodiment of the self-steering three-axle bogie according to the invention.

The drawing shows the running gear 1 of a three-axle bogie, according to the invention, for a rail vehicle. The running gear comprises a running gear frame (not shown in the drawing) which comprises longitudinal and transverse beams.

The wheel set bearing housings 2 to 7 of the three wheel sets 8, 9, 10 are attached to the longitudinal beams by way of spring elements (not shown), namely wheel set bearing housings 2, 3 for the first wheel set 8, which hereinafter is referred to as the first outer wheel set; wheel set bearing housings 4, 5 for the second wheel set 9, which hereinafter is referred to as the central wheel set; and wheel set bearing housings 6, 7 for the third wheel set 10, which hereinafter is referred to as the second outer wheel set. The wheel sets 8, 9, 10 comprise wheels 11. The wheel sets 8, 9, 10 may be driven by drive motors (not shown), for example axle suspension motors or motors mounted on the bogie frame.

The wheel set bearing housings 2, 3, 6, 7 of the two outer wheel sets 8, 10, inter alia can be displaced in the direction of travel or opposite to the direction of travel of the rail vehicle, as indicated by directional arrows x1, x2. The wheel set bearing housings 4, 5 of the central wheel set 9, inter alia can be displaced perpendicularly to the direction of travel of the rail vehicle, as indicated by directional arrows y1, y2.

The wheel set bearing housings 2, 3, 4, 5, 6, 7 are only coupled on the same side of the running gear by way of steering-linkage/rotary lever configurations.

A first steering linkage 12, which in the neutral position as shown in the drawing is arranged transversely to the longitudinal direction of the vehicle, is arranged between a first joint 13 of a first rotary lever, in the form of an angular lever 14, and a second joint 15 on the wheel set bearing housing 3 of the first outer wheel set 8.

The angular lever 14 comprises a first arm 14.1 and a second arm 14.2, with said arms in the embodiment shown being of approximately the same length. However, depending on the desired motion transfer, said arms may also be of different length in other variants.

In the neutral position shown, the first arm 14.1 is aligned essentially perpendicularly in relation to the longitudinal direction of the vehicle, while the second arm 14.2, in this position is aligned essentially parallel in relation to the longitudinal direction of the vehicle.

The angular lever 14 comprises a fulcrum pin 16 which is fixed to the frame, and on the end of its second arm 14.2 is connected to the face of the wheel set bearing 5 of the central wheel set 9, by way of the third joint 17.

A second rotary lever 18 comprising a centred fulcrum pin 19 which is fixed to the frame is associated with the wheel set bearing housing 7 of the second outer wheel set 10; wherein the second steering-linkage 20, which leads to the wheel set bearing housing 7 of the second outer wheel set 10, is connected to the fourth joint 21 of this second rotary lever 18; and wherein the fifth joint 22 of this second rotary lever 18 is connected to a third steering linkage 23 which in turn leads to the already mentioned first joint 13 of the angular lever 14.

In the embodiment shown, the couplings of the wheel set bearing housings 3, 5, 7 of one side of the running gear are built so as to be symmetrically realised, in relation to the longitudinal axis of the rail vehicle, also on the wheel set bearing housings 2, 4, 6 of the other side of the running gear.

A first steering linkage 24, arranged at an inclination, is arranged between a first joint 25 of a first rotary lever in the form of an angular lever 26 and a second joint 27 of the wheel set bearing housing 2.

The angular lever 26 comprises a fulcrum pin 28 which is fixed to the frame and is connected to the front of the wheel set bearing 4 of the central wheel 9 set by way of the third joint 29 of the second arm of said angular lever 26.

A second rotary lever 30 with a centered fulcrum pin 31 which is fixed to the frame is associated with the wheel set bearing housing 6 of the second outer wheel set 10; wherein the second steering linkage 32, which leads to the wheel set bearing housing 6, is connected to the fourth joint 33 of said second rotary lever 30; and wherein the fifth joint 34 of said second rotary lever 30 is connected to a third steering linkage 35 which on the other end leads to the already mentioned first joint 25 of the angular lever 26.

Below, the function of the self-steering three-axle bogie 1 is described.

By coupling the wheel set bearing housing 3 of the first outer wheel set 8 to the wheel set bearing housing 5 of the central wheel set 9 by way of the first steering linkage 12 and the angular lever 14, and coupling the wheel set bearing housing 7 of the second outer wheel set 10 to the wheel set bearing housing 5 of the central wheel set 9 by way of the second steering linkage 20, the second rotary lever 18, the third steering linkage 23 and the angular lever 14, as well as by the symmetrical arrangement on the opposite side of the running gear, in conjunction with the wheel set bearing housings 2, 3, 6, 7 (which can be displaced in the direction of travel (x1) or opposite the direction of travel (x2) of the rail vehicle) of the outer wheel sets 8, 10, and the wheel set bearing housings 4, 5 (which can be displaced in perpendicular direction of travel (y1, y2) of the rail vehicle) of the central wheel set 9, a counter coupling of the outer wheel sets 8, 10 results when the vehicle travels in a curve.

In this arrangement, counter-coupling of the first and second outer wheel sets 8 and 10 is simply effected by designing the second rotary lever 18, 30 with the fourth joint 21, 33 and the fifth joint 22, 34 which in the neutral position is arranged beyond the fulcrum pin 19, 31 in relation to the longitudinal direction of the vehicle.

For example, if the wheel set bearing housing 2 of the first outer wheel set 8 is displaced in the direction x2, then the wheel set bearing housing 6 of the second outer wheel set 10 is constrained to displacement in the direction x1, while the wheel set bearing housing 4 of the central wheel set 9 is constrained to displacement in the direction y1. At the same time, the wheel set bearing housing 3 of the first outer wheel set 8 is displaced in the direction x2, the wheel set bearing housing 7 of the second outer wheel set 10 is displaced in the direction x2 and the wheel set bearing housing 5 of the central wheel set 9 is displaced in the direction y1.

In this arrangement, inclination of the first steering-linkages 12 and 24, due to the resulting motion component which is directed towards the inside of the track curve, favours an alignment of the first outer wheel set 8 which alignment is radial in relation to the track curve, and thus favours a reduction in the striking angle between the outer wheel of the outer wheel set 8 and the outer rail of the track curve.

The components of the arrangement—in particular the rotary levers 14, 18 as well as 26, 30, the steering linkages 12, 20, 23 as well as 24, 32, 35 and their joints as well as rotational axes—are arranged and designed such that in a wide range of radii of curvature of the track the first outer wheel set 8 and the second outer wheel set 10 are at least to a considerable extent aligned radially in relation to the curved track. In other words, a striking angle of less than 5° results between the outer wheels of the outer wheel sets 8, 10 and the outer rail of the curved track. In a wide range of radii of curvature, this striking angle is essentially 0°.

The invention claimed is:

1. A self-steering three-axle bogie comprising:

a first outer wheel set associated with a first outer wheel set bearing housing located on one side of the bogie;

a second outer wheel set associated with a second outer wheel set bearing housing located on said one side of the bogie;

a central wheel set located between the first and second outer wheel sets and associated with a central wheel set bearing housing located on said one side of the bogie; and a steering system for coupling the wheel set bearing housings in such a way that the first and second outer wheel set bearing housing are movable in a longitudinal direction of the bogie opposite to one another while the central wheel set bearing housing is movable in a transverse direction of the bogie, the steering system comprising:

a first rotary lever connected to the central wheel set bearing housing, the first rotary lever comprising an angular lever comprising a first arm and a second arm and a fulcrum pin which is fixed to the frame; and a first steering linkage assembly for coupling the first rotary lever to the first outer wheel set bearing housing and a second steering linkage assembly for coupling the first rotary lever to the second outer wheel set bearing housing, the first steering linkage assembly comprising a first steering linkage, arranged at an angle in relation to the longitudinal direction, and provided between a first joint on the first rotary lever and a second joint on the first outer wheel set bearing housing;

the first steering linkage assembly further comprising a third joint for connecting the rotary lever to a face of the central wheel set bearing housing, wherein the first joint is arranged on the first arm of the first rotary lever and the third joint is arranged on the second arm of the first rotary lever;

the second steering linkage assembly further comprising:

a second rotary lever pivotally connected to the frame via a second fulcrum pin, the second rotary lever comprising fourth and fifth joints arranged on opposite sides of the second fulcrum pin;

a second steering linkage coupled to the fourth joint of the second rotary lever and to the second outer wheel set bearing housing; and a third steering linkage coupled to the fifth joint of the second rotary lever and to the first rotary lever, wherein the second fulcrum pin is centred between the fourth and fifth joints.

2. A self-steering three-axle bogie comprising:

a first outer wheel set associated with a first outer wheel set bearing housing located on one side of the bogie;

a second outer wheel set associated with a second outer wheel set bearing housing located on said one side of the bogie;

a central wheel set located between the first and second outer wheel sets and associated with a central wheel set bearing housing located on said one side of the bogie; and a steering system for coupling the wheel set bearing housings in such a way that the first and second outer wheel set bearing housing are movable in a longitudinal direction of the bogie opposite to one another while the central wheel set bearing housing is movable in a transverse direction of the bogie, the steering system comprising:

a first rotary lever connected to the central wheel set bearing housing, the first rotary lever comprising an angular lever comprising a first arm and a second arm and a fulcrum pin which is fixed to the frame; and a first steering linkage assembly for coupling the first rotary lever to the first outer wheel set bearing housing and a second steering linkage assembly for coupling the first rotary lever to the second outer wheel set bearing housing, the first steering linkage assembly comprising a first steering linkage, arranged at an angle in relation to the longitudinal direction, and provided between a first joint on the first rotary lever and a second joint on the first outer wheel set bearing housing;

the first steering linkage assembly further comprising a third joint for connecting the rotary lever to a face of the central wheel set bearing housing, wherein the first joint is arranged on the first arm of the first rotary lever and the third joint is arranged on the second arm of the first rotary lever;

the second steering linkage assembly further comprising:

a second rotary lever pivotally connected to the frame via a second fulcrum pin, the second rotary lever comprising fourth and fifth joints arranged on opposite sides of the second fulcrum pin;

a second steering linkage coupled to the fourth joint of the second rotary lever and to the second outer wheel set bearing housing; and a third steering linkage coupled to the fifth joint of the second rotary lever and to the first rotary lever, wherein the third steering linkage is coupled to the first joint on the first rotary lever.

* * * * *